US006889530B2

(12) United States Patent
Urano et al.

(10) Patent No.: US 6,889,530 B2
(45) Date of Patent: May 10, 2005

(54) METHOD OF FORMING GUSSET AND KNITWEAR COMPRISING GUSSET FORMED

(76) Inventors: Kouichi Urano, c/o Shima Seiki Mfg. Ltd., 85 Sakata, Wakayama-shi Wakayama (JP), 641-8511; Hiroko Ochiai, c/o Shima Seiki Mfg. Ltd., 85 Sakata, Wakayama-shi Wakayama (JP), 641-8511

( * ) Notice: Subject to any disclaimer, the term of this patent is extended or adjusted under 35 U.S.C. 154(b) by 0 days.

(21) Appl. No.: 10/491,623

(22) PCT Filed: Sep. 30, 2002

(86) PCT No.: PCT/JP02/10198

§ 371 (c)(1),
(2), (4) Date: Oct. 5, 2004

(87) PCT Pub. No.: WO03/031707

PCT Pub. Date: Apr. 17, 2003

(65) Prior Publication Data

US 2005/0028562 A1 Feb. 10, 2005

(30) Foreign Application Priority Data

Oct. 5, 2001 (JP) ..... 2001-309493

(51) Int. Cl.[7] ..... D04B 7/10
(52) U.S. Cl. ..... 66/64; 66/176
(58) Field of Search ..... 66/64, 69, 170–176, 66/60 R, 189, 75.1

(56) References Cited

U.S. PATENT DOCUMENTS 5,203,185 A * 4/1993 Okuno ..... 66/171
5,987,930 A 11/1999 Nakai
6,286,340 B1 * 9/2001 Yui ..... 66/70
6,564,588 B1 * 5/2003 Nonnenmacher et al. ..... 66/69
6,581,417 B2 * 6/2003 Yui ..... 66/176
6,655,175 B1 * 12/2003 Okamoto ..... 66/69
6,658,899 B2 * 12/2003 Okamoto ..... 66/64
6,748,770 B2 * 6/2004 Okamoto ..... 66/64

FOREIGN PATENT DOCUMENTS

| | | | |
|---|---|---|---|
| JP | 33-14238 | Y1 | 9/1958 |
| JP | 52-2652 | B2 | 1/1977 |
| JP | 3-75656 | B2 | 12/1991 |
| JP | 7-150403 | A | 6/1995 |
| JP | 3108987 | B2 | 11/2000 |

* cited by examiner

*Primary Examiner*—Danny Worrell

(57) ABSTRACT

A method of forming gussets in armpits of knitwear in the process of joining together sleeves and a body of the knitwear to form a tubular body, while reducing the tubular body in diameter from the underarms toward the shoulders to form armholes. The method comprises the step (a) the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of armholes toward shoulder portions while the loops of the body at lateral ends thereof and the loops of the sleeves at lateral ends thereof are overlapped with each other to join together the body and the sleeves, and the step (b) subsequently to the step (a), the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one. This method can allow the knitting of the knitwear of comfort to wear with the gussets formed therein.

4 Claims, 11 Drawing Sheets

METHOD OF FORMING GUSSET AND KNITWEAR COMPRISING GUSSET FORMED

This application is a 35 USC § 371 National Phase Entry Application form PCT/JP02/10198, filed Sept. 30, 2002, and designating the U.S.

TECHNICAL FIELD

The present invention relates to a method of forming a gusset at a joint portion between a body and a sleeve of knitwear such as a sweater knitted by using a flat knitting machine and to knitwear having a gusset formed therein.

BACKGROUND ART

Joining together fabric parts knitted on the flat knitting machine during a knitting process can allow simplification or omission of a sewing process in a later stage. By the application of this technique to the knitting of knitwear such as a sweater, the knitwear can be formed in a tubular form in a seamless manner via the flat knitting machine.

The applicant previously proposed the knitting technique of forming the knitwear into a tubular form in Japanese Patent Publication No. Hei 3(1991)-75656. The proposed knitting technique is applicable to a so-called two-bed flat knitting machine comprising front and back needle beds arranged opposite to each other, for knitting a knitted fabric with alternate needles of front and back needle beds, for example, using odd needles for a front fabric part and even needles for a back fabric part. According to this knitting technique, empty needles for transference of loop of each fabric part can be always kept on the opposite needle bed. This enables several structure patterns of front stitches and back stitches being mixed, such as links, purl stitches, and ribs, to be knitted in a tubular form and also enables the sleeve to move transversely to be joined to a body.

The proposed knitting technique is also applicable to a four-bed flat knitting machine further comprising another pair of front and back needle beds. In this case, front fabric parts of e.g. sleeves and a body, can be knitted with needles of a lower front needle bed and an upper back needle bed, and also back fabric parts thereof can be knitted with needles of a lower back needle bed and an upper front needle bed. Thus, when the knitting technique is applied to the four-bed flat knitting machine, there is no need to allot the front fabric part to the odd needles and the back fabric part to the even needles, as is required when applied to the two-bed knitting machine.

FIG. 9 shows a sweater 101 of set-in sleeve as an example of the knitwear. FIG. 10 shows a pattern of a body 105 and a sleeve 103. For the set-in sleeve, a sleeve attaching angle θ is determined by a height h of a sleeve cap 109. On the other hand, for a T-sleeve having no sleeve cap, the sleeve attaching angle θ is set to be a right angle. In the set-in sleeve, as the sleeve cap increases in height, the sleeve attaching angle θ decreases and the sleeve falls downward increasingly. FIG. 11-A shows knitting steps for knitting the sweater 101 of the set-in sleeve seamlessly by the flat knitting machine, and FIG. 11-B schematically shows the knitting in the respective stages R1–R5 of FIG. 11-A.

The sweater 101 is knitted in the following manner: The body 105 and the right sleeve 103*r* and left sleeve 1031 are each knitted in the form of a tubular body, starting at hems 107*r*, 1071 (Stage R1). The body 105 and the sleeves 103*r*, 1031 in the form of the tubular body are simultaneously knitted up to underarms, while increasing a diameter of the tubular body (Stage R2). It should be noted that the right sleeve 103*r* is on the right-hand side as viewed from a wearer, in other words, on the left-hand side as viewed in the drawing. The body 105 and the sleeves 103*r*, 1031 are joined together at the underarms 108 and formed into a single large tubular body (Stage R3). In this stage, the line connecting between Q0 and Q1 (line Q0–Q1) at the underarm 108 of the body 105 and the line connecting between Q6 and Q7 (line Q6–Q7) of the sleeve are joined together to form an underarm neighboring portion of an armhole 117. This joining is carried out in such a manner that while a yarn is fed to the needles holding loops of the sleeves 103 and the body 105 in a circular pattern and whenever the body and the sleeves are knitted at a ratio of the number of courses of the body knitted to the number of courses of the sleeves knitted of one to one, the sleeves 103*r*, 1031 are shifted toward the body 105. As a result of this, a width of the body is reduced to a width of the shoulder.

Then, after the underarm portion of the armhole 117 is formed, the line Q1–Q2 of the body 105 and the line Q7–Q8 of the sleeve 103 are joined together. This joining is carried out in such a manner that whenever the body and the sleeves are knitted at a ratio of the number of courses of the body knitted to the number of courses of the sleeves knitted of two to one, the loops of sleeves 103*r*, 1031 are shifted toward the body 105 and are overlapped with the loops of the body 105. Then, the tubular body is knitted with its diameter reduced gradually (Stage R4). The ratio of the number of courses of the body knitted to the number of courses of the sleeves knitted has such a relationship that as the proportion of the number of courses of the sleeves knitted increases, the sleeve cap increases in height, while on the other hand, as the proportion of the number of courses of the body knitted increases, the sleeve cap decreases in height. For the sleeve, no course knitting of the sleeves is performed. During this knitting, a neckline 113 is also formed. In the stage R5, the forming of loop courses of the sleeves 103 is ended and only the forming of loop courses of the body 105 is performed. Whenever a predetermined number of loop courses of the body 105 are formed, the loops of the sleeves held on the needles are shifted toward the body 105 and are overlapped with the loops of the body 105, whereby the line Q2–Q3 of the body 105 and the line Q8–Q9 of the sleeve are joined together in the armhole 117.

Thereafter, the front body 105*f* and the back body 105*b* are joined together at the shoulder and bound off. The knitting of the sweater 101 is ended in the manner mentioned above.

For the production of garment, it is important to design the garment considering not only an outline or silhouette of the garment but also a contour and movement of the human body. For the sweater 101 having the set-in sleeves joined to the body, it is necessary to design the sweater in such a manner as to put no limitation on the movement of a wearer's arm when raising or falling. For a textile product of low stretch, separate cloths are sewn in the textile at the joining portion between the sleeves and the body to form gussets so that when the textile is stretched at the underarm portions in response to the movement of the wearer's arms, the textile can be prevented from being torn or broken, or conversely, the movement of the wearer's arm can be prevented from being limited by the textile.

For knitwear having higher stretch than textile, it is not common to use equivalent to the gusset of the textile, but the stretch of the knitwear alone is not sufficient to the act of being stretched at the underarm portions.

It is an object of the present invention to disclose a method of forming a gusset in knitwear during the knitting to join together a body and sleeves of the knitwear knitted in a seamless manner by using a flat knitting machine, and knitwear having the gusset formed therein.

DISCLOSURE OF THE INVENTION

In order to solve the problems mentioned above, the present invention provides a novel method for forming gussets in knitwear having a body and right and left sleeves joined together by using a flat knitting machine comprising at least a pair of front and back needle beds extending laterally and arranged opposite to each other in a longitudinal direction to define a needle bed gap therebetween, each of which has a large number of needles and at least either of which can be racked laterally to receive and transfer loop between the needle beds, wherein the right and left sleeves and the body are arranged in parallel on the flat knitting machine and are each knitted in the form of a tubular body from cuffs of the sleeves and a hem of the body up to underarms and, then, the sleeves and the body are joined together, while courses of the sleeves knitted and courses of the body knitted are formed by feeding a yarn to needles holding loops of the sleeves and loops of the body in such a circular pattern that the sleeves and the body can be joined into a single large tubular body and also the tubular body is reduced in diameter from the underarms toward the shoulders to form armholes, in the process of which the gussets are formed in underarm portions of the knitwear, the method comprising:

(a) the step that the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and (b) the step that subsequently to the step (a), the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one.

According to this construction of the present invention, the right and left sleeves and the body are arranged in parallel on different regions of the flat knitting machine and are each knitted in the form of a tubular body from cuffs of the sleeves and a hem of the body up to underarms at which the joining of the sleeves and the body is started. Then, after completion of the knitting up to the underarms at which the joining of the sleeves and the body is started, armholes are formed while the sleeves and the body are joined together by feeding a yarn is fed to the sleeves and the body adjacent thereto in such a circular pattern that the sleeves and the body can be formed into a single tubular body. In the process of forming the armholes, while the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, loops of the body at lateral ends thereof and loops of each sleeve at a lateral end thereof are overlapped with each other to join together the body and the sleeves. Thereafter, subsequently to the completion of the joining at the underarm portions, while the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one, the sleeves are shifted toward the body to join together the sleeves and the body, thereby forming the armholes. When the sleeves and the body are joined together by this knitting method comprising the knitting steps recited above, an underarm portion of the sleeve located at a lower portion of the armhole and an upper portion of the sleeve are joined to the body at different joining angles from each other. As a result of the underarm portion of the sleeve and the upper portion of the sleeve being joined to the body at different joining angles from each other; the sleeves are bent flexibly to form the gussets in the knitwear.

Also, the present invention provides a novel method for forming gussets in knitwear having a body and right and left sleeves joined together by using a flat knitting machine comprising at least a pair of front and back needle beds extending laterally and arranged opposite to each other in a longitudinal direction to define a needle bed gap therebetween, each of which has a large number of needles and at least either of which can be racked laterally to receive and transfer loop between the needle beds, wherein the right and left sleeves and the body are arranged in parallel on the flat knitting machine and are each knitted in the form of a tubular body from cuffs of the sleeves and a hem of the body up to underarms and, then, the sleeves and the body are joined together, while courses of the sleeves knitted and courses of the body knitted are formed by feeding a yarn to needles holding loops of the sleeves and loops of the body in such a circular pattern that the sleeves and the body can be joined into a single large tubular body and also the tubular body is reduced in diameter from the underarms toward the shoulders to form armholes, in the process of which the gussets are formed in underarm portions of the knitwear, the method comprising:

(a) the step of that a knitting width of the body is narrowed gradually in underarm neighboring portions and also the sleeves are shifted toward the body and joined thereto while knitting the body and the sleeves at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, thereby forming the gussets, and (b) the step that subsequently to the step (a), in parallel with the knitting of the body and the sleeves at a ratio of the number of courses of the body knitted to the number of courses of the sleeves knitted of one to one, an appropriate number of loops of the sleeves located at both lateral ends are shifted inwardly and overlapped with adjacent loops, to form double loops, thereby forming loops of a next course including the double loops, this knitting process being repeatedly performed.

According to this construction of the present invention, the right and left sleeves and the body are arranged in parallel on different regions of the flat knitting machine and are each knitted in the form of a tubular body from cuffs of the sleeves and a hem of the body up to underarms at which the joining of the sleeves and the body is started. Then, after completion of the knitting up to the underarms at which the joining of the sleeves and the body is started, armholes are formed while the sleeves and the body are joined together by feeding a yarn is fed to the sleeves and the body adjacent thereto in such a circular pattern that the sleeves and the body can be formed into a single tubular body. In the process of forming the armholes, while the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, loops of the body at lateral ends thereof and loops of each sleeve at a lateral end thereof are overlapped with each other to join together the body and the sleeves. Thereafter, subsequently to the completion of the joining at the underarm portions, while the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one, an appropriate number of loops of the sleeves located at both ends are shifted inwardly and overlapped with adjacent loops. This knitting process is repeatedly performed to narrow a diameter of the tubular body gradually. When the sleeves and the body are joined together by this knitting method comprising the knitting steps recited above, an underarm portion of the sleeve located at a lower portion of the armhole and an upper portion of the sleeve are joined to the body at different joining angles from each other. As a result of the underarm portion of the sleeve and the upper portion of the sleeve being joined to the body at different joining angles from each other, the sleeves are bent flexibly to form the gussets in the knitwear.

Also, the present invention provides a novel knitwear having gussets formed in the knitwear comprising a body and sleeves which are each knitted in the form of a tubular body and joined together in armholes, wherein the knitwear includes two different regions formed in armpits at lower part of armholes, one being a region where the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and another being a region, formed continuously from the underarm portions, where the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one.

Further, the present invention provides a novel knitwear having gussets formed in the knitwear comprising a body and sleeves which are each knitted in the form of a tubular body and joined together in armholes, wherein the knitwear includes two different regions formed in armpits at lower part of armholes, one being a region where the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and another being a region, formed continuously from the underarm portions, where the body and the sleeves are knitted at a ratio of the number of courses of the body knitted to the number of courses of the sleeves knitted of one to one and also an appropriate number of loops of the sleeves located at both ends are shifted inwardly and overlapped with adjacent loops to form double loops, thereby forming loops of a next course including the double loops, this knitting process being repeatedly performed.

BEST MODE FOR CARRYING OUT THE INVENTION

In the following, certain preferred embodiments of the present invention will be described with reference to the accompanying drawings. In this embodiment, the knitting is performed by using a two-bed flat knitting machine. A general type of flat knitting machine can be used which has at least one pair of front and back needle beds extending in a lateral direction and arranged opposite to each other in a cross direction, with a needle bed gap defined therebetween, each of which has a large number of needles and at least either of which can be racked laterally to transfer loops between the needle beds.

First Embodiment

Figure 1:
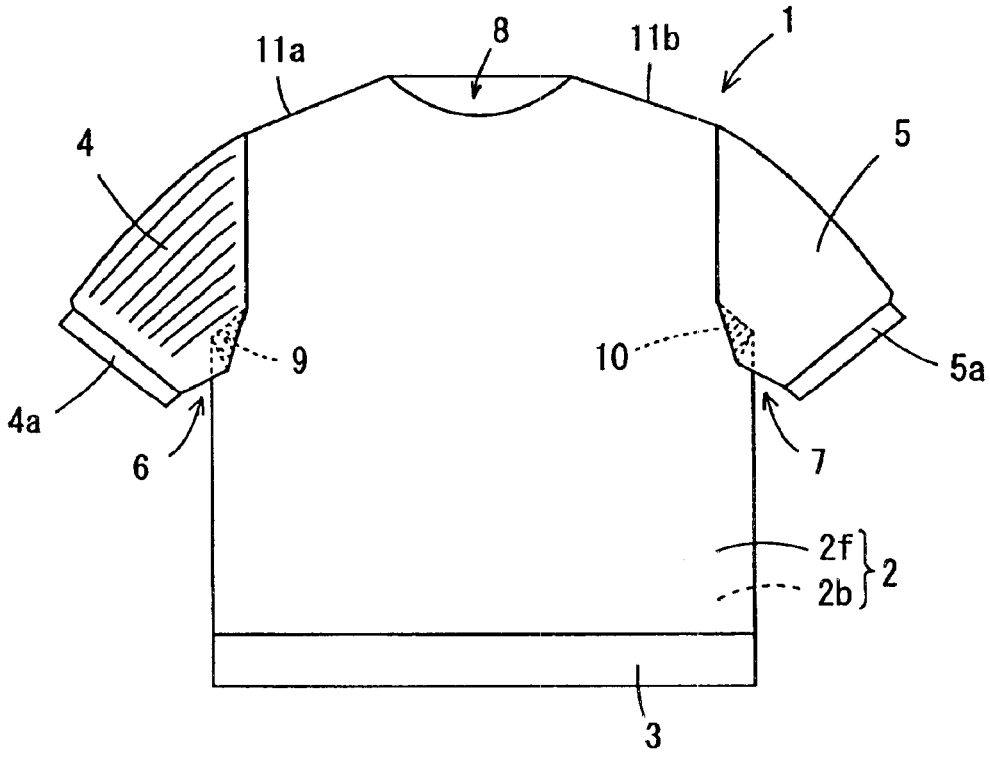
FIG. 1 shows a sweater 1 formed in accordance with a first embodiment of the present invention.
Figure 2:
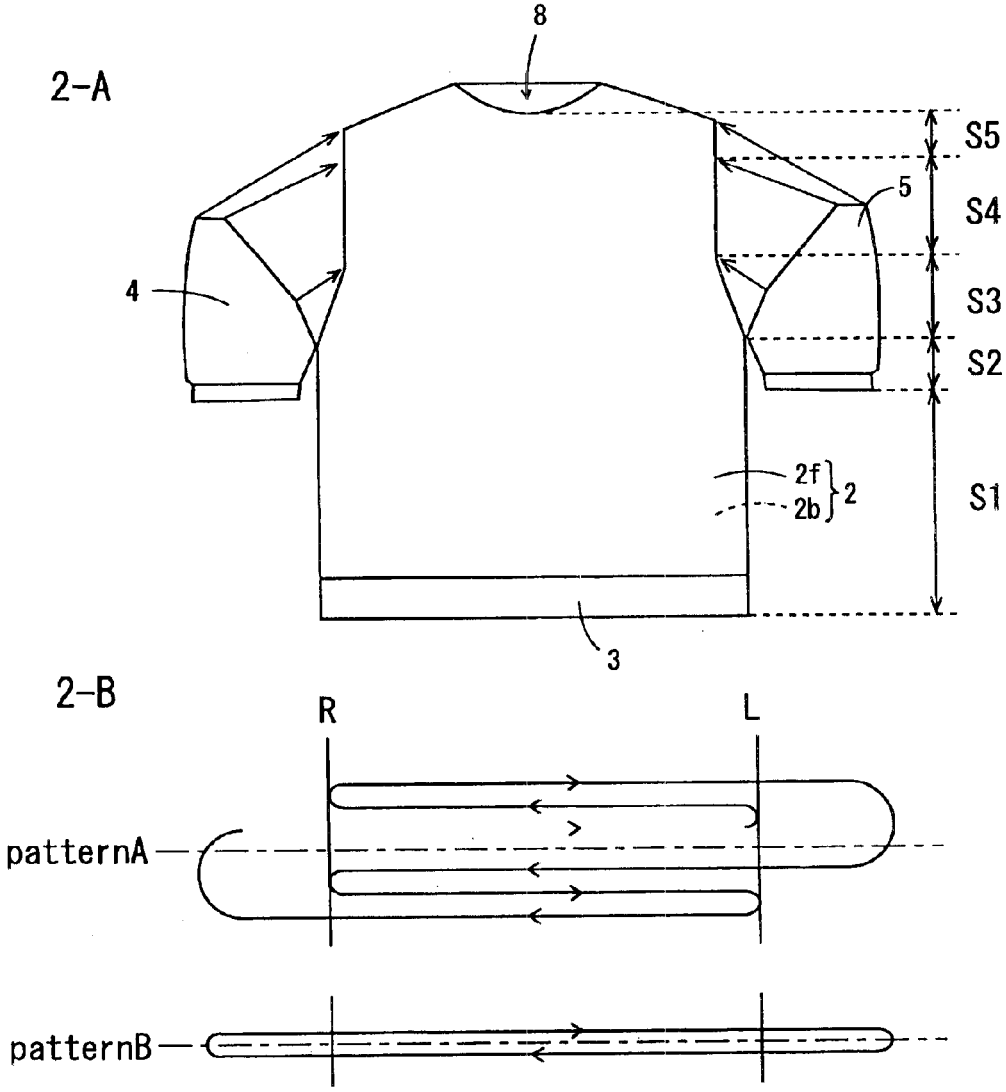
FIG. 2-A shows the process step of knitting the sweater 1 seamlessly by a flat knitting machine and FIG. 2-B shows a carrier arrangement in the stage S3 of FIG. 2-A.
Figure 3:
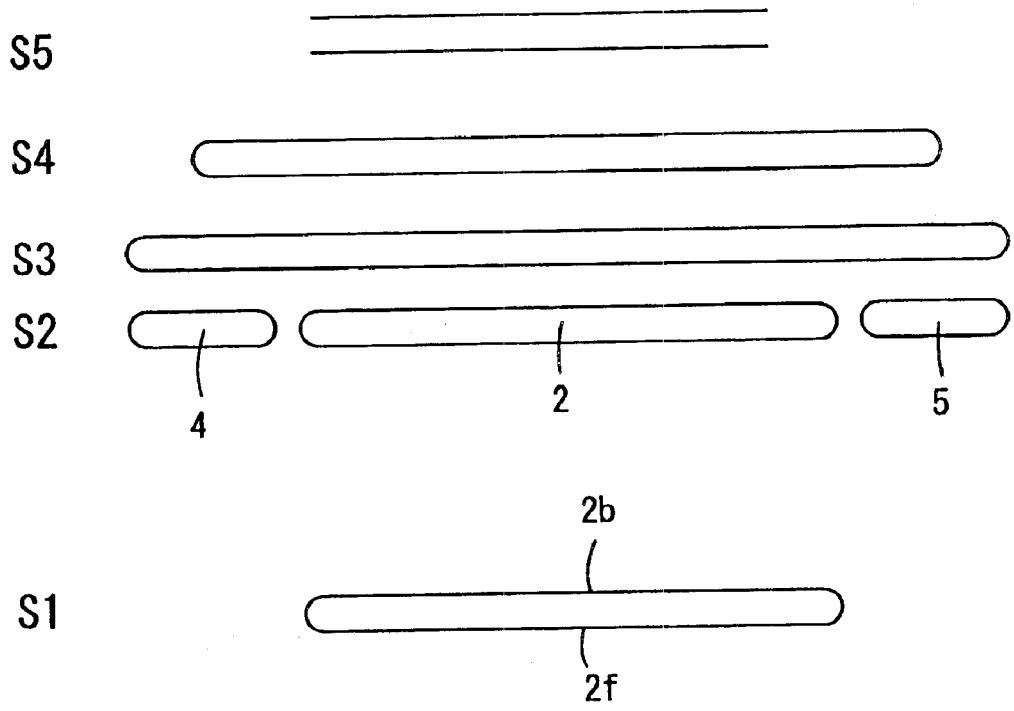
FIG. 3 shows the knitting in the stages S1–S5 of FIG. 2-A.
Figure 4:
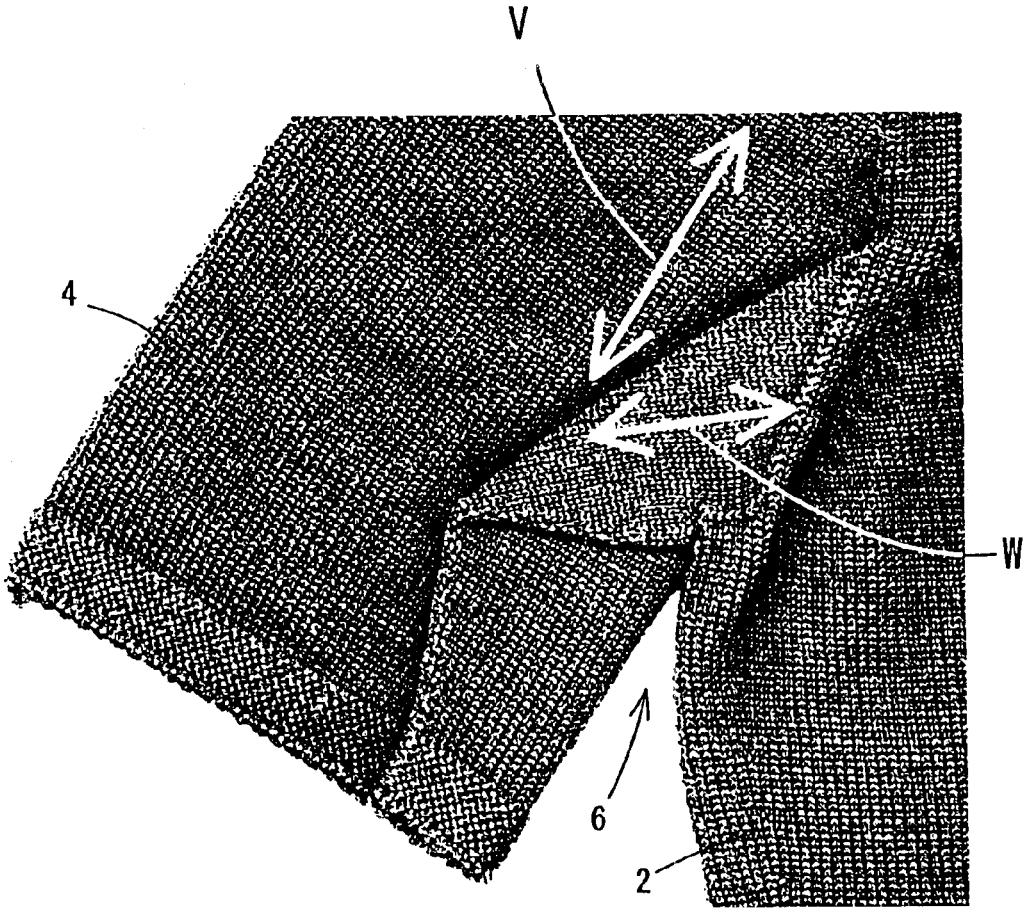
FIG. 4 shows a right underarm portion of the sweater 1.

FIG. 1 shows a short-sleeved sweater 1 having set-in sleeves knitted by a flat knitting machine in accordance with a first embodiment of the present invention. FIG. 2-A schematically shows the process step of knitting the sweater 1 seamlessly by the flat knitting machine, and FIG. 2-B shows a carrier arrangement in the stage S3 of FIG. 2-A. FIG. 3 shows the yarn feed and movement of knitted fabrics when viewed from above the needle beds in the stages S1–S5 of FIG. 2. FIG. 4 shows a right underarm portion of the sweater 1 actually knitted in accordance with the first embodiment.

The sweater 1 is knitted in the following manner. A body 2 consisting of a front body 2*f* and a back body 2*b* is knitted in a tubular body, starting at its hem 3 (Stage S1). While the body 2 is knitted up to underarm portions 6, 7 at which the joining of the right and left sleeves 4, 5 is started, the knitting of right and left sleeves 4, 5 are started at their cuffs 4*a*, 5*a*. The sleeves 4, 5 are knitted up to the underarms at the same time that the body 2 is knitted, while increasing a diameter of the tubular sleeves (Stage S2).

Then, the joining of the body 2 and the sleeves 4, 5 is started at the underarms. Subsequently, the body and the sleeves are formed into a single large tubular body by feeding a yarn thereto. Whenever the body 2 and the sleeves 4, 5 are knitted, loops of the sleeves 4, 5 are shifted toward the body 2 and overlapped with loops of the body 2 to form double loops. Then, loops of the next course are formed in the double loops and thereby the right and left sleeves 4, 5 are joined to the body 2 while the knitting width of the body 2 is narrowed gradually (Stage S3). The yarn is fed to the body 2 and the right and left sleeves 4, 5 by following the pattern A and the pattern B of FIG. 2-B in alternate order. In FIG. 2-B, the part depicted above a dashed line indicates the back body/back sleeve part, and the part depicted below the dashed line indicates the front body/front sleeve part. Lines R and L indicate a boundary between the body 2 and the right sleeve 4 and a boundary between the body 2 and the left sleeve 5, respectively. The part between the lines R and L corresponds to the body; the part at the left-hand side of the line R corresponds to the right sleeve 4; and the part at the right-hand side of the line L corresponds to the left sleeve 5. By knitting the pattern A and the pattern B in alternate order, a ratio of the number of courses of the body knitted to the number of courses of the sleeve knitted is set to be eight to four, i.e., two to one.

When the knitting of the stage S3 is completed, the yarn is fed to the right and left sleeves 4, 5 and the body 2 in a wide circular motion by the same yarn feeder. Whenever the sleeves 4, 5 and the body 2 are knitted, one course for each, the sleeves 4, 5 are shifted toward the body 2, so that the sleeves are joined to the body at a ratio of the number of courses of the body knitted to the number of courses of the sleeves knitted is one to one (Stage S4). Sequentially, after the knitting of the sleeves 4, 5 is stopped, the front body 2*f* and the back body 2*b* are knitted by different yarn feeders, respectively. Whenever the front and back bodies 2*f*, 2*b* are knitted, one course for each, the sleeves 4, 5 are shifted toward the body 2 and loops in the final course of the sleeves 4, 5 are overlapped with loops of the body 2 at lateral ends thereof, whereby the sleeves 4, 5 are joined to the body 2 (Stage S5). After the knitting mentioned above, the front body 2*f* and the back body 2*b* are joined together at right and left shoulders 11*a*, 11*b* and are bound off by a known binding-off process. Thereafter, a neckline opening 8 is formed. The sweater 1 is knitted in the manner mentioned above.

The sweater 1 thus knitted has a region where a ratio of the number of courses of the body knitted to the number of courses of the sleeves knitted is two to one in the underarm portion formed in the stage S3 (the underarm portion is intended to include an area placed under the arm when the product is completed, which is varied in position and width, depending on a sleeve-attachment angle to the body and a shape of the sleeve). It also has a region where a ratio of the number of courses of the body knitted to the number of courses of the sleeves knitted is one to one in an upper portion of the sleeve formed in the stage S4. Referring to FIG. 4, there is shown a photographic image of one side part of an actual sweater knitted by the method mentioned above. As shown in FIG. 4, the upper portions of the sleeves are joined to the body in the armholes in a wale direction (indicated by an arrow V in FIG. 4) in which the upper portions of the sleeves are attached to the body at a shallow sleeve-attachment angle. On the other hand, the underarm portions of the sleeves 4, 5 are joined to the body 2 in a wale direction (indicated by an arrow W in FIG. 4) in which the underarm portions of the sleeves 4, 5 are attached to the body 2 at a deep sleeve-attachment angle. This difference in wale direction between the upper portions of the sleeves 4, 5 and the underarm portions of the sleeves 4, 5 allows the forming of bendable gussets 9, 10 in the knitted fabric. The gussets 9, 10 thus formed can make the knitwear comfortable to wear and can also allow free movement of the arms. A length of the gussets formed in the underarms varies depending on the shape of the sleeves and a gauge of the flat knitting machine. To cite one example, the sweater knitted by a 12-gauge flat knitting machine has a length of the gusset of 5 cm on the front body side and a length of the same of 5 cm on the back body side, and the number of courses of the body knitted during the forming of the gussets of 40.

Although the ratio of the number of courses of the body knitted to the number of courses of the sleeves knitted is set to be two to one at the underarm portion in the embodiment described above, it is enough that the ratio of the number of courses of the body knitted to the number of courses of the sleeves knitted is set to be two to one or at a ratio higher in proportion of the number of courses of the body knitted than the ratio of the number of courses of the body knitted to the number of courses of the sleeves knitted is set to be two to one. For example, the ratio of the number of courses of the body knitted to the number of courses of the sleeves knitted may be set to be three to one.

Second Embodiment

Figure 5:
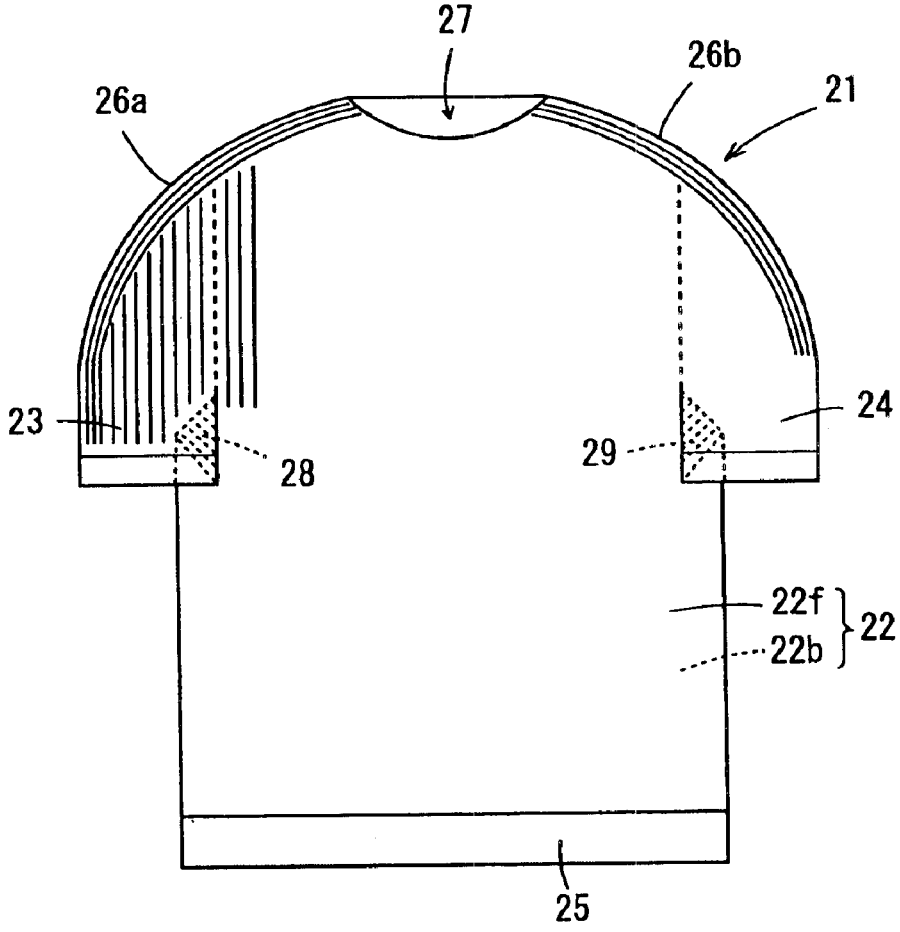
FIG. 5 shows a sweater 21 formed in accordance with a second embodiment of the present invention.
Figure 6:
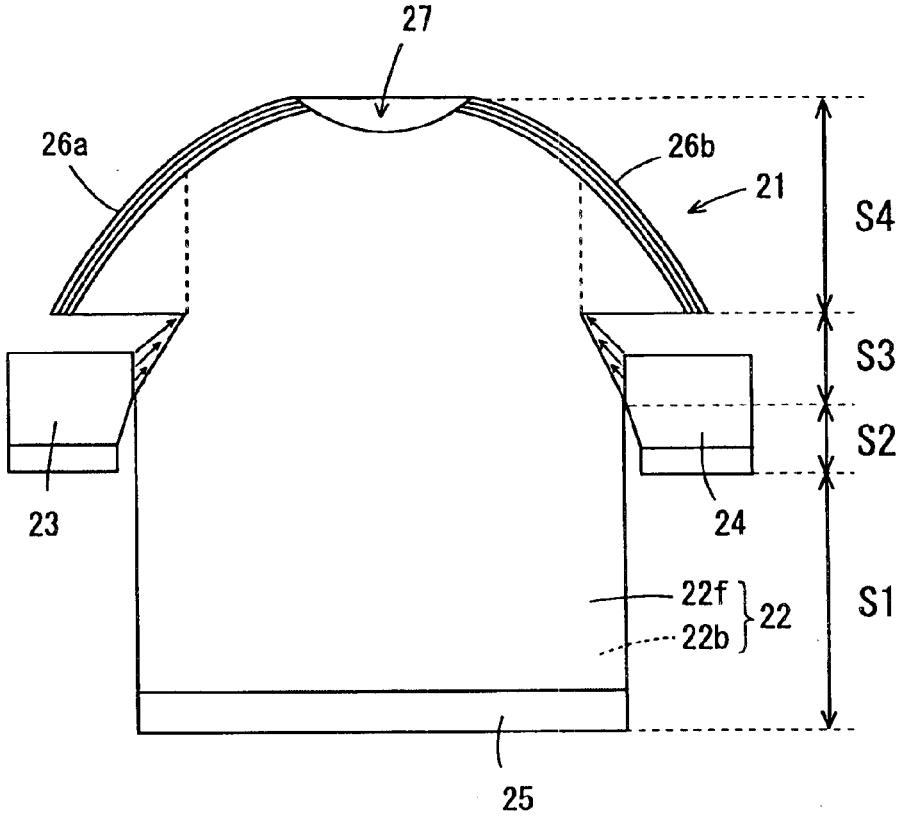
FIG. 6 shows the process step of knitting the sweater 21 in a seamless manner by the flat knitting machine.
Figure 7:
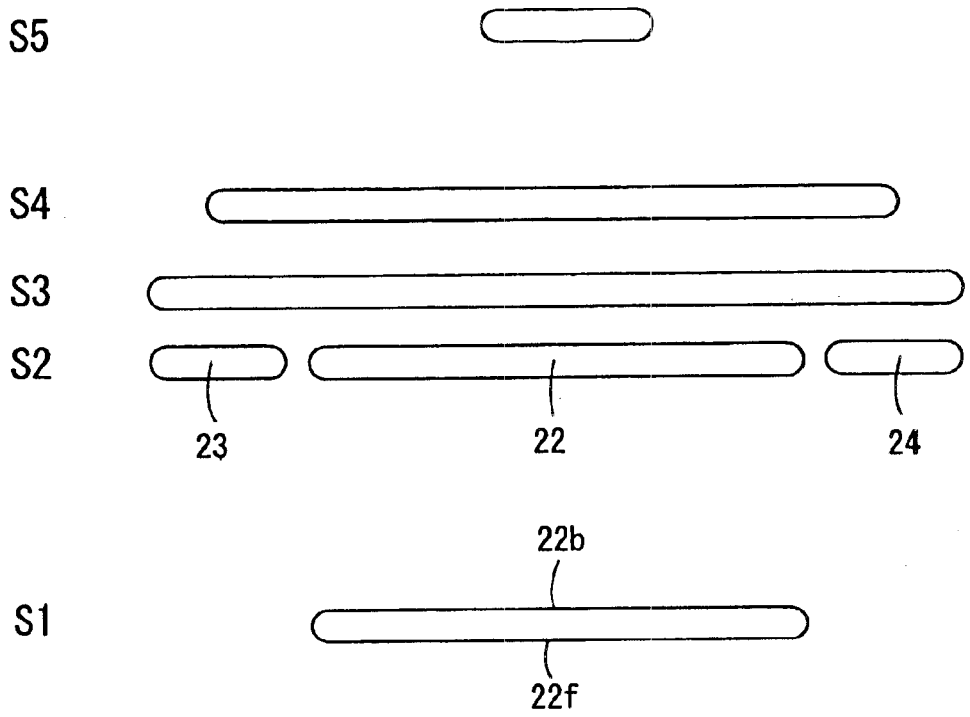
FIG. 7 shows the knitting in the stages S1–S5 of FIG. 6.
Figure 8:
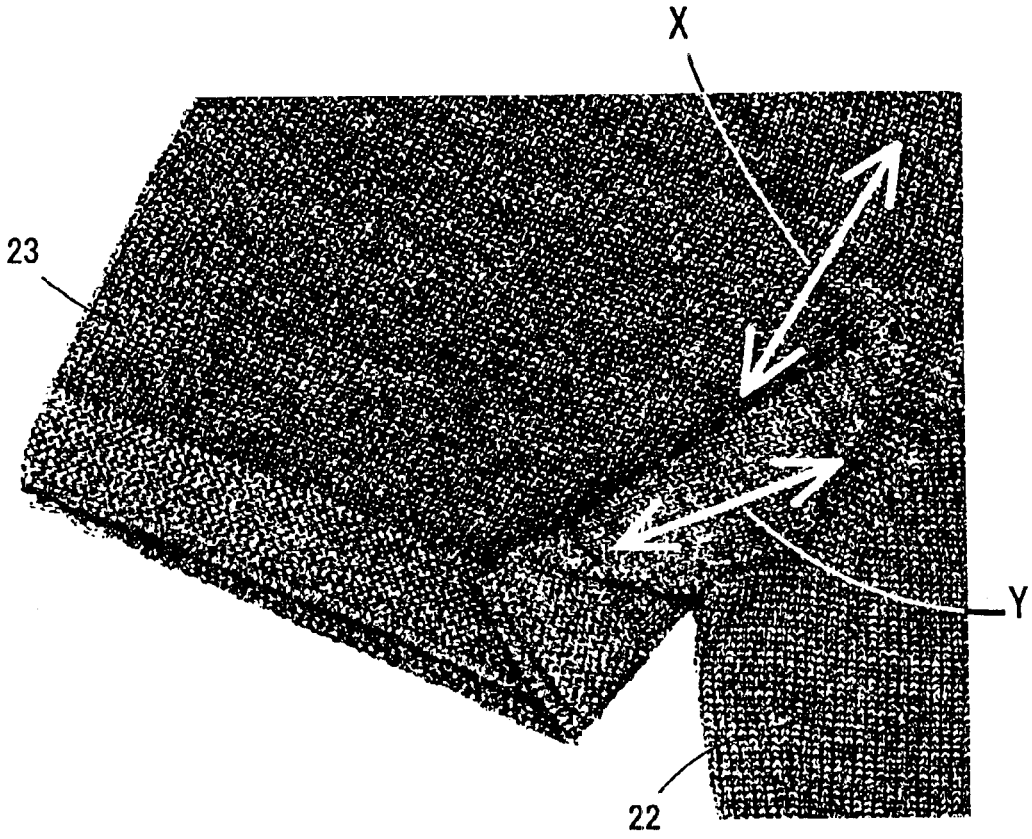
FIG. 8 shows a right underarm portion of the sweater 21.
Figure 9:
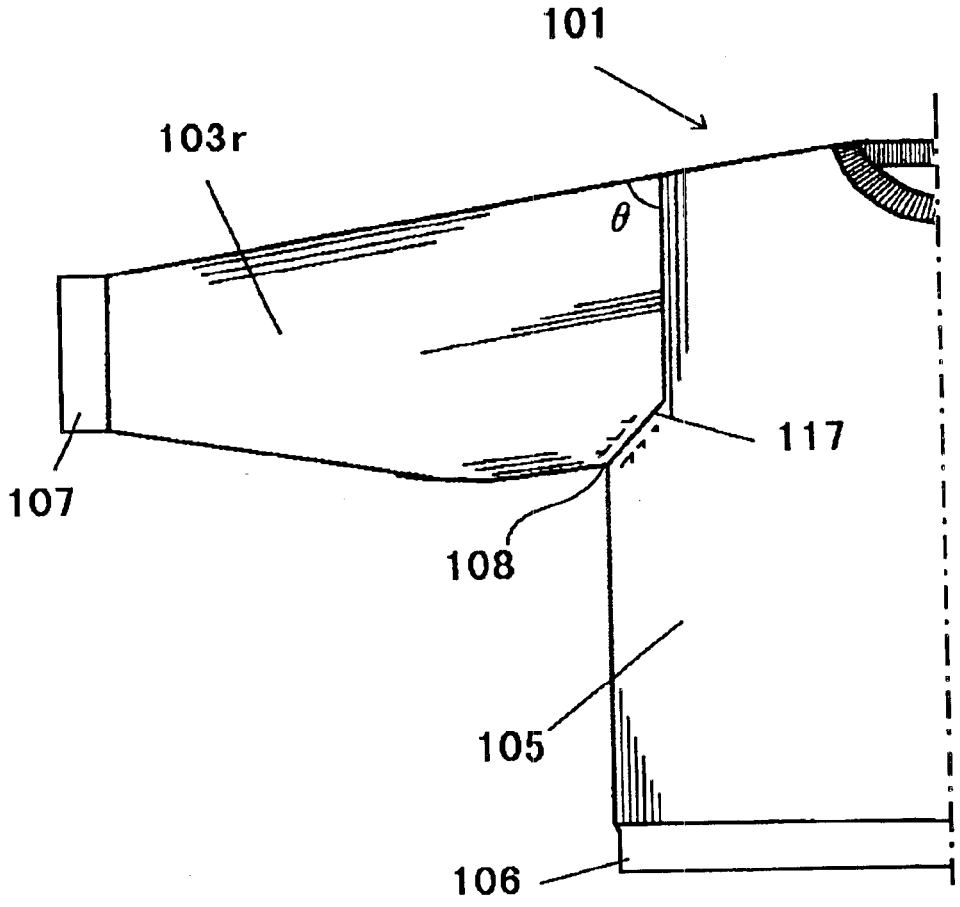
FIG. 9 shows a sweater 101 knitted by a conventional method.
Figure 10:
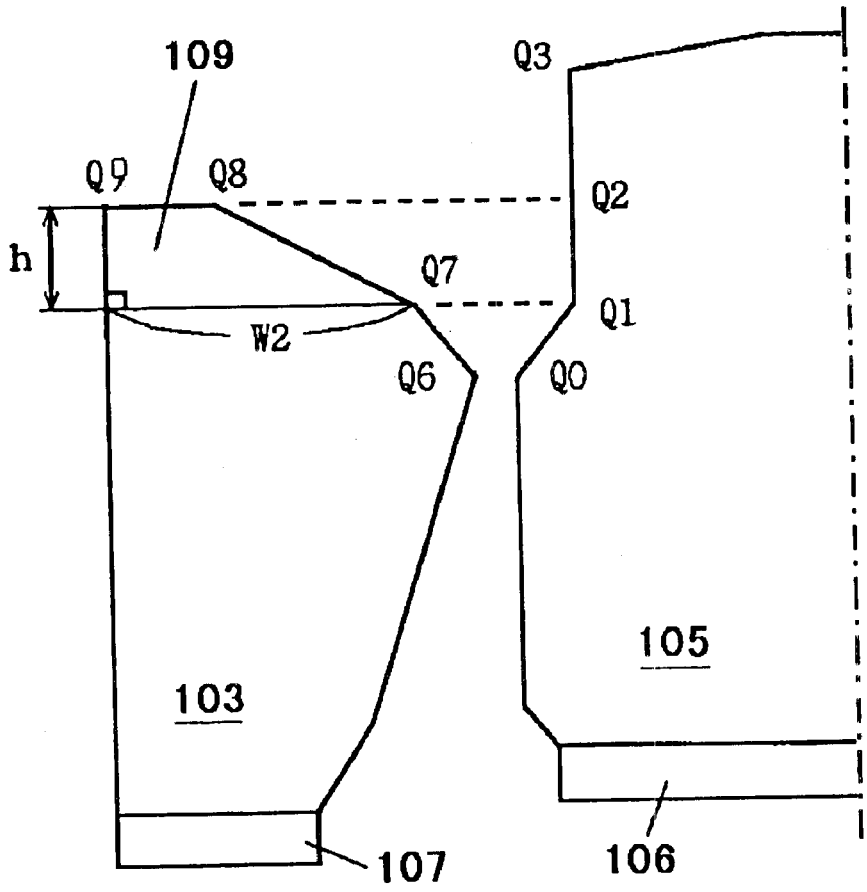
FIG. 10 shows a pattern of a body and a sleeve of the sweater 101 joined by the conventional method.
Figure 11:
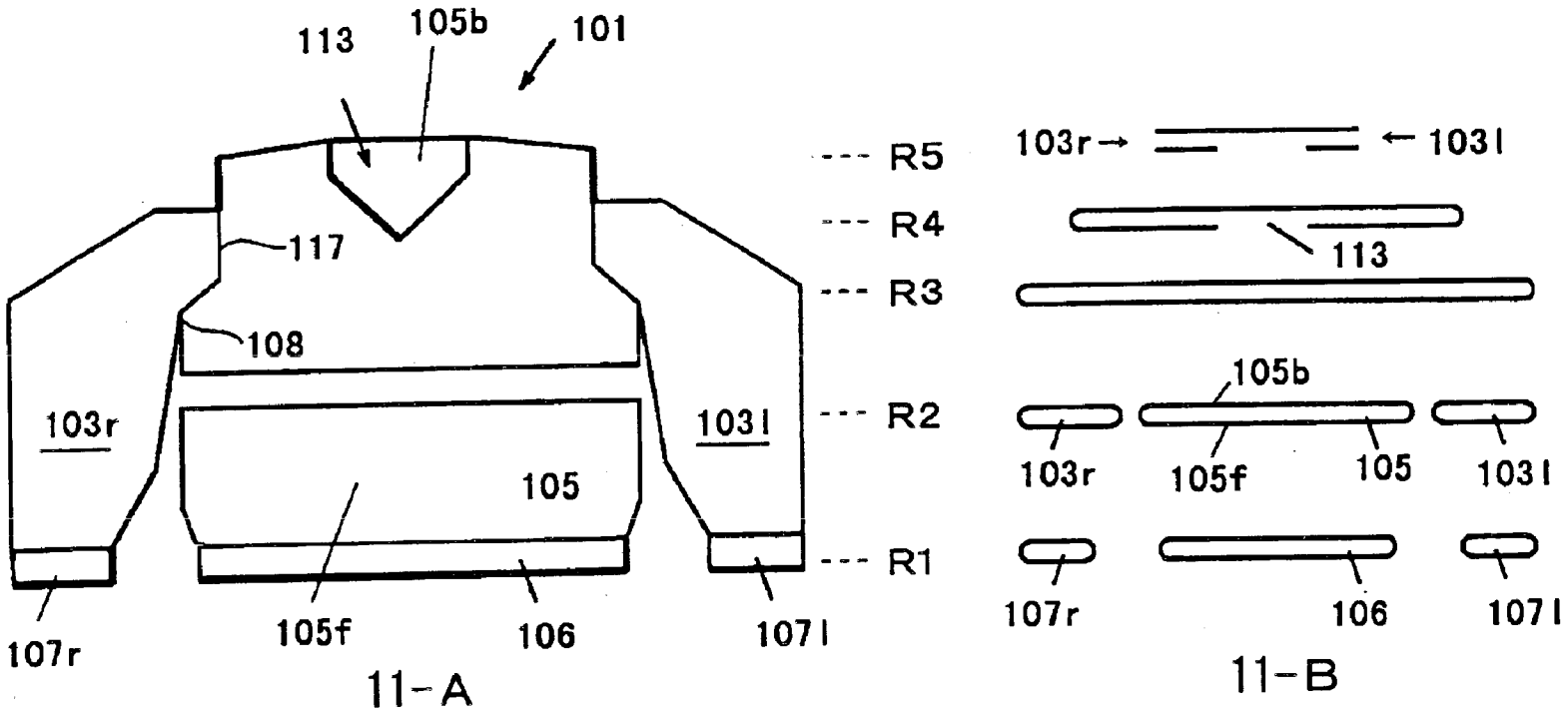
FIG. 11-A shows the process step of knitting the sweater 101 by the conventional method, and FIG. 11-B shows the knitting in the stages R1–R5 of FIG. 11-A.

Next, reference is made of the second embodiment of the invention. In the second embodiment, a sweater 21 of a novel design is knitted in which the sleeves are identical in wale direction with the body as shown in FIG. 5. FIG. 6 schematically shows the process step of knitting the sweater 21 in a seamless manner by the flat knitting machine. FIG. 7 shows the yarn feed and movement of knitted fabrics when viewed from above the needle beds in the stages S1–S4 of FIG. 6. FIG. 8 is a photographic image showing a right underarm portion of the sweater 21 actually knitted in accordance with the second embodiment.

In the second embodiment, a body 22 is knitted starting from its hem 25 and a front body 22*f* and a back body 22*b* are knitted in a tubular body toward an underarm portion (Stage S1). While the body 22 is knitted up to the underarms, the knitting of right and left sleeves 23, 24 are started. The sleeves 23, 24 and the body 2 are knitted in parallel (Stage S2). After completion of the knitting of the sleeves 23, 24 and the body 22 up to the underarm portion, the yarn is fed to the right and left sleeves 23, 24 and the body 22 in a wide circular motion by the same yarn feeder. Whenever the pattern A and the pattern B of FIG. 2-B are knitted in alternate order, the right and left sleeves 23, 24 are shifted toward the body 22. Then, the loops of the sleeves 23, 24 are overlapped with the loops of the body 22 to form loops of the next course. By repetition of this knitting, the sleeves 23, 24 and the body 22 are joined together (Stage S3). In the stage S4 or later, the sleeves 23, 24 and the body 22 are knitted into a single body, with the pattern B of FIG. 2-B repeatedly knitted. Then, the knitting for narrowing is performed in the following manner (Stage S4). That is to say, while the body and the sleeves are knitted into the single tubular body by feeding a yarn to the front and back needle beds in a circular pattern, an appropriate number of loops of the sleeves 23, 24 located at both lateral ends of the body are shifted inwardly and overlapped with loops located at the inward side thereof, to form double loops and, then, the yarn is fed to the whole area of the body 22 including the double loops to form loops of the next course (Stage S4). By repetition of this knitting of the stage S4, gently inclined shoulder portions 26*a*, 26*b* are formed in the sweater 21. Thereafter, a neckline opening 27 is formed in the front body 22*f*. The sweater 21 is completed in the manner described above.

In the sweater knitted in accordance with the second embodiment, the upper portions of the sleeves 23, 24 are joined to the body 22 in a wale direction (indicated by an arrow X in FIG. 8) in which the underarm portions of the sleeves 23, 24 are attached to the body 22 at a deep sleeve-attachment angle. Then, after completion of the joining of the underarm portions of the sleeves 23, 24 and the body 22, the remaining portions of the sleeves are joined to the body at a ratio of the number of courses of the body knitted to the number of courses of the sleeves knitted of one to one, so that the remaining portions of the sleeves are formed in a wale direction (indicated by an arrow Y in FIG. 8) in which the remaining portions of the sleeves to be attached to the body at a shallower sleeve-attachment angle than in the wale direction in which the underarm portions of the sleeves are attached to the body. This difference in wale direction between the underarm portions of the sleeves 23, 24 and the remaining portions of the sleeves 23, 24 formed after the sleeves 23, 24 and the body 22 are formed into the single tubular body allows the forming of bendable gussets 28, 29 in the underarms of the knitted fabric. The gussets 28, 29 thus formed can make the knitwear comfortable to wear and can also allow free movement of the arms, even when the sleeves 23, 24 and the body 22 are joined together with the cuffs facing downward. In this embodiment, after the sleeves 23, 24 and the body 22 are joined together, the narrowing of the sleeves 23, 24 is carried out at both ends, thus forming ideal gently-inclined shoulder lines 26*a*, 26*b* with no projection extending from the sleeves 23, 24 to the shoulders. In the sweater 21 knitted in accordance with the second embodiment, the sleeves 23, 24 are formed in the same wale direction as the body 22 and orient downwardly, as shown in FIG. 5. When the sweater with the sleeves 23, 24 orienting downward is formed by a conventional knitting method, the sweater lacks the gussets, thus producing the problem that when a wearer stretches the arms upward to put on the sleeved sweater, the motion of the wearer's body is significantly limited by the sleeves. In the sweater 21 of the second embodiment, this problem can be avoided by virtue of the gussets 28, 29 even when the sweater is formed with the sleeves 23, 24 orienting downwardly.

Although the knitting of the short-sleeved sweater has been described in the first and second embodiments cited above, the method of the present invention is practically applicable to long-sleeved sweaters. In addition, the method of the present invention is also applicable to other knitwear than the sweater, such as a polo shirt and a cardigan. Also, the method of the present invention is practically applicable to a four-bed flat knitting machine comprising upper needle beds arranged over the pair of lower front/back needle beds, as well as to the two-bed flat knitting machine in the embodiments described above. Further, the gussets can be formed, for example, in a tights as well as in the sweater by the knitting process wherein right and left leg portions of the tights, which correspond to the right and left sleeves of the sweater, are each previously knitted in the form of a tubular body, with a crotch forming portion sandwiched between the right and left leg portions, and, thereafter, the set-up knitting for a waist portion or a further portion is started at the crotch forming portion.

Capabilities of Exploitation in Industry

According to the present invention, the gussets can be formed in the joining portions between the body and the sleeves of the knitwear, such as the sweater, in the process of knitting for joining together the body and the sleeves on the flat knitting machine, as mentioned above, thus achieving simplification or omission of a sewing process in a later stage.

What is claimed is:

1. A method for forming gussets in knitwear comprising a body and right and left sleeves joined together by using a flat knitting machine comprising at least a pair of front and back needle beds extending laterally and arranged opposite to each other in a longitudinal direction to define a needle bed gap therebetween, each of which has a large number of needles and at least either of which can be racked laterally to receive and transfer loop between the needle beds, wherein the right and left sleeves and the body are arranged in parallel on the flat knitting machine and are each knitted in the form of a tubular body from cuffs of the sleeves and a hem of the body up to underarms and, then, the sleeves and the body are joined together, while courses of the sleeves knitted and courses of the body knitted are formed by feeding a yarn to needles holding loops of the sleeves and loops of the body in such a circular pattern that the sleeves and the body can be joined into a single large tubular body and also the tubular body is reduced in diameter from the underarms toward the shoulders to form armholes, in the process of which the gussets are formed in underarm portions of the knitwear, the method comprising:

(a) the step that the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and (b) the step that subsequently to the step (a), the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one.

2. A method for forming gussets in knitwear comprising a body and right and left sleeves joined together by using a flat knitting machine comprising at least a pair of front and back needle beds extending laterally and arranged opposite to each other in a longitudinal direction to define a needle bed gap therebetween, each of which has a large number of needles and at least either of which can be racked laterally to receive and transfer loop between the needle beds, wherein the right and left sleeves and the body are arranged in parallel on the flat knitting machine and are each knitted in the form of a tubular body from cuffs of the sleeves and a hem of the body up to underarms and, then, the sleeves and the body are joined together, while courses of the sleeves knitted and courses of the body knitted are formed by feeding a yarn to needles holding loops of the sleeves and loops of the body in such a circular pattern that the sleeves and the body can be joined into a single large tubular body and also the tubular body is reduced in diameter from the underarms toward the shoulders to form armholes, in the process of which the gussets are formed in underarm portions of the knitwear, the method comprising:

(a) the step that a knitting width of the body is narrowed gradually in underarm neighboring portions and also the sleeves are shifted toward the body and joined thereto while knitting the body and the sleeves at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, thereby forming the gussets, and (b) the step that subsequently to the step (a), in parallel with the knitting of the body and the sleeves at a ratio of the number of courses of the body knitted to the number of courses of the sleeves knitted of one to one, an appropriate number of loops of the sleeves located at both ends are shifted inwardly and overlapped with adjacent loops, to form double loops, thereby forming loops of a next course including the double loops, this knitting process being repeatedly performed.

3. Knitwear having gussets formed in the knitwear comprising a body and sleeves which are each knitted in the form of a tubular body and joined together in armholes, wherein the knitwear includes two different regions formed in armpits at lower part of armholes, one being a region where the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and another being a region, formed continuously from the underarm portions, where the body and the sleeves are knitted at a ratio of the number of courses of the body knitted to the number of courses of the sleeves knitted of one to one or at a ratio higher in proportion of the number of courses of the sleeves knitted than the ratio of the number of courses of the body knitted to the number of courses of the sleeves knitted of one to one.

4. Knitwear having gussets formed in the knitwear comprising a body and sleeves which are each knitted in the form of a tubular body and joined together in armholes, wherein the knitwear includes two different regions formed in armpits at lower part of armholes, one being a region where the body and the sleeves are knitted at a ratio of the number of courses of the body knitted to the number of courses of the sleeves knitted of two to one or at a ratio higher in proportion of the number of courses of the body knitted than the ratio of the number of courses of the body knitted to the number of courses of the sleeves knitted of two to one, and also a knitting width of the body is narrowed gradually from lower ends of the armholes toward the shoulder portions while the loops of the body at lateral ends thereof and the loops of the sleeves at lateral ends thereof are overlapped with each other to join together the body and the sleeves, and another being a region, formed continuously from the underarm portions, where the body and the sleeves are knitted at a ratio of the number of courses of the body knitted to the number of courses of the sleeves knitted of one to one and also an appropriate number of loops of the sleeves located at both ends are shifted inwardly and overlapped with adjacent loops to form double loops, thereby forming loops of a next course including the double loops, this knitting process being repeatedly performed.

* * * * *